US006557647B2

(12) United States Patent
White

(10) Patent No.: US 6,557,647 B2
(45) Date of Patent: May 6, 2003

(54) IMPACT HAMMER SYSTEMS AND METHODS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 09/867,991

(22) Filed: May 29, 2001

(65) Prior Publication Data

US 2002/0014342 A1 Feb. 7, 2002

Related U.S. Application Data

(60) Provisional application No. 60/208,125, filed on May 30, 2000.

(51) Int. Cl.[7] ..... E02D 7/10

(52) U.S. Cl. ..... 173/17; 173/91; 173/128; 173/206

(58) Field of Search ..... 173/17, 1, 128, 173/206, 207, 208, 15, 13, 49

(56) References Cited

U.S. PATENT DOCUMENTS 4,382,475 A * 5/1983 Suzuki ..... 173/206
5,526,885 A * 6/1996 Kuvshinov et al. ..... 173/17
5,806,610 A * 9/1998 Sapozhnikov ..... 173/128
5,924,498 A * 7/1999 Nilsen ..... 173/206
6,378,951 B1 * 4/2002 Bouyoucos et al. ..... 173/206

* cited by examiner

*Primary Examiner*—Scott A. Smith
(74) *Attorney, Agent, or Firm*—Michael R. Schacht; Schacht Law Office, Inc.

(57) ABSTRACT

An impact hammer system for driving an elongate member comprising a ram member, a frame assembly, an actuator assembly, and a power source. The ram member defines a ram bore. The frame assembly supports the ram member such that the ram member may move relative to the frame assembly between first and second positions. The actuator assembly is operatively connected between the frame assembly and the ram member and is operable in extended and retracted configurations. At least a portion of the actuator assembly is disposed within the ram bore and a substantial portion of the actuator assembly extends out of the ram bore when the cylinder is in the extended position. The power source is operatively connected to the actuator assembly to place the actuator assembly in the extended and retracted configurations. Extension and retraction of the actuator assembly moves the ram member between the first and second positions, respectively. The ram member impacts the elongate member when the ram member moves into the second position.

12 Claims, 9 Drawing Sheets

IMPACT HAMMER SYSTEMS AND METHODS

RELATED APPLICATIONS

This application claims priority of U.S. Provisional Patent Application Ser. No. 60/208,125, which was filed on May 30, 2000.

TECHNICAL FIELD

The present invention relates to impact hammers for driving elongate members such as piles into the earth and, more specifically, to hydraulic impact hammers having low headroom for use in restricted access locations.

BACKGROUND OF THE INVENTION

Construction projects often require elongate members to be driven into the earth. In the present application, the term "elongate member" shall refer to any member that must be forced, driven, crowded, or pounded into the earth. Examples of elongate members include metal or wooden piles, caissons, wick drain mandrels, and the like.

A number of techniques are commonly used to drive elongate members into the earth. For example, elongate members may be driven into the earth by an impact hammer (hydraulic and/or gravity driven) that pounds on the exposed end of the elongate member, a vibratory device that imparts a relatively high frequency up and down motion on the elongate member, a gear or wheel drive system that engages the sides of the elongate member, a cable and pulley system that exerts a crowding force on the top of the elongate member, or some combination of these techniques. The present invention is an impact hammer device.

The present invention is of particular use in environments, such as under a bridge, having restricted headroom. An impact hammer device employs a ram member that is raised and then dropped against the upper end of the elongate member being driven. The act of raising and dropping requires at least enough headroom to accommodate the vertical height between the raised height and the dropped height. Additional headroom is required by the structure employed to raise and lower the ram member. One purpose of the present invention is to reduce the headroom required by an impact hammer device.

RELATED ART

The Applicant is aware of prior art single-acting pile hammers sold by MKT Corporation under model numbers MS350 and MS500. These pile hammers include a ram assembly comprising a ram member defining a cavity and cylinder cover that covers the cavity. The ram assembly forms a cylinder for a pneumatic piston assembly. A piston rod extends through the cylinder cover such that a piston head is located within the cavity. Air under pressure is introduced into the cylinder above the piston head to raise the ram member. When fully raised, the pressurized air is released from the cylinder to allow the ram member to drop and impact a pile or other elongate member to be driven. The released air is simply vented to the atmosphere.

The arrangement of the MKT systems effectively locates the lifting apparatus within the ram member and connects the lifting apparatus to the bottom of the ram member. The overall height of the pile hammer is thus reduced, making these systems appropriate for use in low headroom situations.

The MKT systems have relatively limited driving capacity for the total volume of the system. The need thus exists for low headroom impact hammer systems with increased driving capacity for a given volume occupied by the system.

SUMMARY OF THE INVENTION

The present invention is an impact hammer system for driving an elongate member. The impact hammer system comprises a ram member, a frame assembly, an actuator assembly, and a power source. The ram member defines a ram bore. The frame assembly supports the ram member such that the ram member may move relative to the frame assembly between first and second positions. The actuator assembly is operatively connected between the frame assembly and the ram member and is operable in extended and retracted configurations.

At least a portion of the actuator assembly is disposed within the ram bore and a substantial portion of the actuator assembly extends out of the ram bore when the cylinder is in the extended position. The power source is operatively connected to the actuator assembly to place the actuator assembly in the extended and retracted configurations. Extension and retraction of the actuator assembly moves the ram member between the first and second positions, respectively. The ram member impacts the elongate member when the ram member moves into the second position.

DETAILED DESCRIPTION OF THE INVENTION

Figure 1:
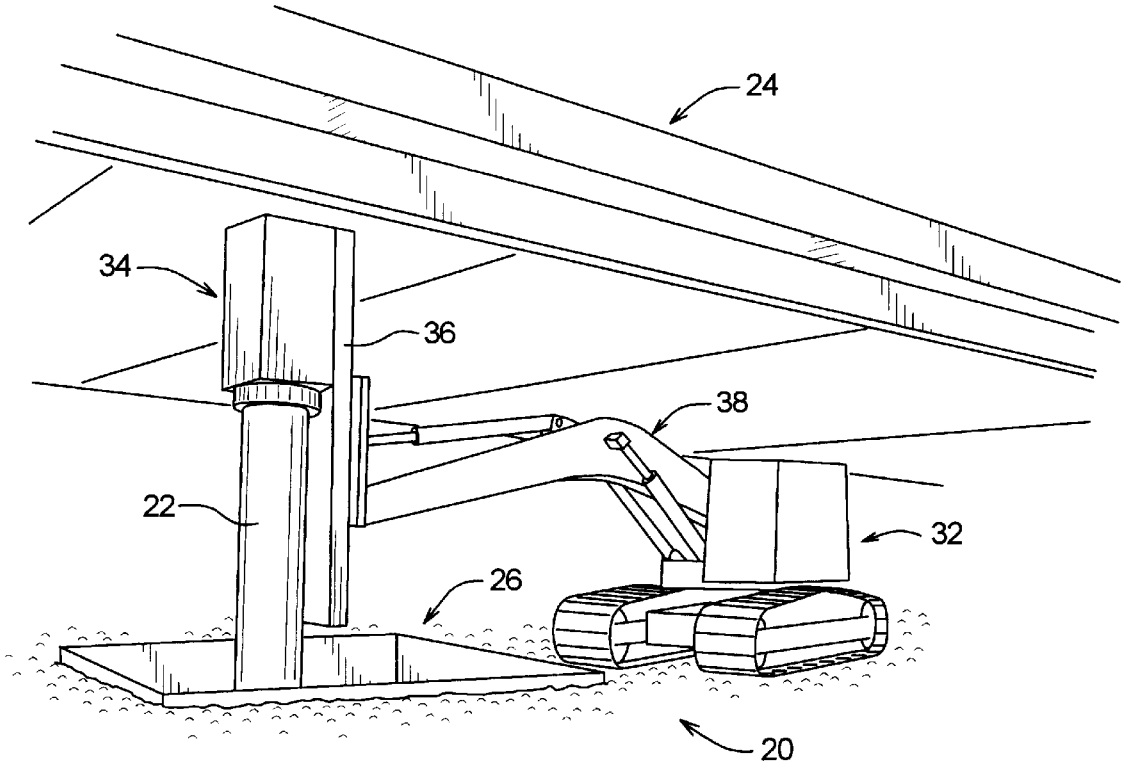
FIG. 1 is a perspective view of a pile driving system incorporating an impact hammer system constructed in accordance with, and embodying, the principles of the present invention.
Figure 6A:
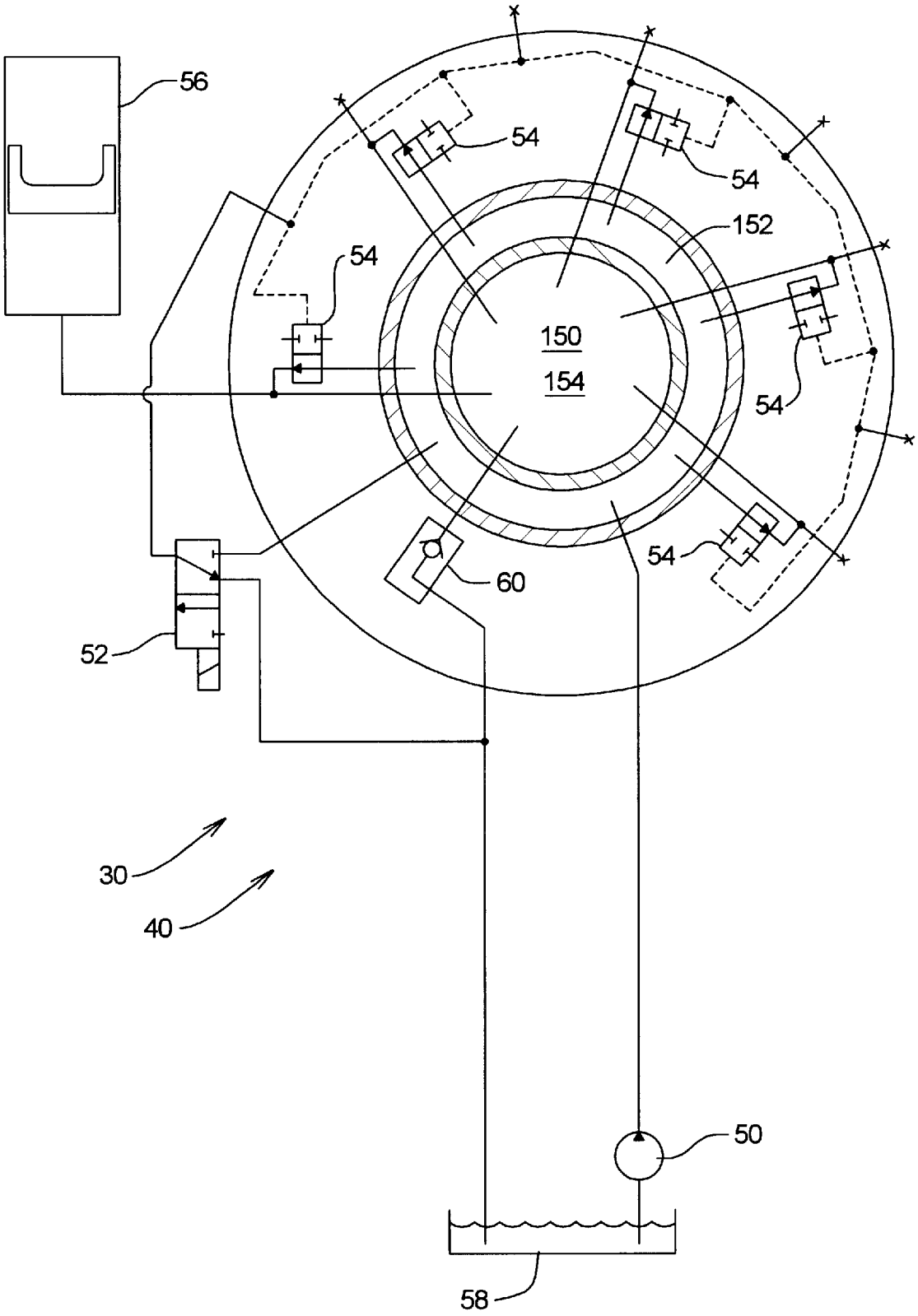
FIGS. 6A and 6B are schematic views depicting a hydraulic system forming a part of the impact hammer system of FIG. 1 in lifting and dropping states.

Referring initially to FIG. 1, depicted therein at 20 is a pile driving system adapted to drive a pile 22. The pile 22 is being driven under a bridge 24 at an excavated location 26. The environment in which the pile driving system 20 is depicted is thus commonly referred to as a low headroom situation. The pile driving system 20 comprises an impact hammer system 30 (FIGS. 6 and 7) and a vehicle 32. As shown in FIG. 1, an impact hammer assembly 34 of the impact hammer system 30 is secured to a mounting plate 36 at a distal end of a spotting arm 38 of the vehicle 32. The vehicle 32 and spotting arm 38 are conventional and allow the plate 36, and thus the hammer system 30, to be moved as necessary to engage and drive the pile 22 at the location 26. The impact hammer system 30 comprises the impact hammer assembly 34 described above and a hydraulic system 40.

Referring specifically to FIGS. 6 and 7, the hydraulic system 40 comprises a fluid source 50, a master control valve 52, slave control valves 54, an accumulator 56, a reservoir 58, and a check valve 60. The fluid source 50 is a pump embodied as a power pack capable of generating a steady supply of pressurized hydraulic fluid. The power pack is conventional and, for clarity, is not shown in FIG. 1. The operation of the hydraulic system 40 will be described in further detail below.

The construction and operation of the impact hammer assembly 34 is depicted in FIGS. 2–5. In particular, the hammer assembly 34 comprises a ram member 120, a frame assembly 122, and an actuator assembly 124. The ram member 120 defines a ram bore 126. The frame assembly 122 supports the ram member 120 for movement between first (FIG. 2) and second (FIGS. 1 and 3), or in this case upper and lower, positions. The actuator assembly 124 resides substantially within the ram bore 126 when the ram member 120 is in the first or upper position.

The actuator assembly 124 moves between retracted (FIG. 2) and extended (FIGS. 1 and 3) configurations, and the effective length of the actuator assembly 124 is longer when the assembly 124 is in the extended configuration.

The actuator assembly 124 is connected at one end to the frame assembly 122 and at its other end to the ram member 120. Accordingly, placing the actuator assembly 124 in the retracted configuration causes the ram member 120 to move to the upper position, and the ram member 120 is in the lower position when the actuator assembly 124 is in the extended configuration.

The basic principles of the actuator assembly 124 are well known, and actuators other than the exemplary actuator assembly 124 may be used to implement the principles of the present invention. But the exemplary actuator assembly 124 contains features that make the actuator assembly 124 particularly suited for use in the impact hammer assembly 34.

Initially, the actuator assembly 124 comprises a wall assembly 130 and a piston assembly 132. The piston assembly 132 moves relative to the wall assembly 130, and this movement of the piston assembly 132 relative to the wall assembly 130 defines the retracted and extended positions.

The wall assembly 130 is rigidly connected to the frame assembly 122, and the piston assembly 132 is rigidly connected to the ram member 120. This arrangement, while not essential to implement the present invention, is preferred because hydraulic fluid may be introduced more easily into the wall assembly 130 when this assembly is fixed to the frame assembly 122.

In addition, the wall assembly 130 comprises an inner or piston cylinder 134, an outer cylinder 136, and a cylinder cap 138. The piston cylinder 134 is arranged within the outer cylinder 136, while the cylinder cap 138 seals one end of each of the piston and outer cylinders 134 and 136. The piston assembly 132 comprises a piston rod 140 and a piston head 142 secured to the rod 140. The piston head 142 is located within the piston cylinder 134, and the piston rod 140 extends through the cylinder cap 138.

Again, a double cylinder arrangement is not necessary to implement the present invention, but is desired because the outer cylinder 136 allows a fluid flow path that simplifies fluid flow into and out of the piston cylinder 134 on both sides of the piston head 142.

The piston cylinder 134 of the exemplary actuator assembly 124 defines an inner housing chamber 150, and the outer cylinder 134 thereof defines an outer housing chamber 152. The piston head 142 divides the inner housing chamber 150 into first and second chamber portions 154 and 156. The second chamber portion 156 is in fluid communication with the outer housing chamber 152 through openings 158 (FIG. 7) in the piston cylinder 134.

Referring again to FIGS. 6 and 7, these figures schematically depict the relationship of the hydraulic system 40 to the first and second portions 154 and 156 of the inner housing chamber 150.

In particular, the fluid source 50 is in direct communication with the outer housing chamber 152 and, through the openings 158, with the second portion of the inner housing chamber 150. Thus, operation of the fluid source 50 forces hydraulic fluid into the inner housing chamber 150 below the piston head 142. This causes the piston head 142 to move upward and lift the 120 into the first position.

To move the piston head 142 upward, the master control valve 52 is placed in a first configuration (FIGS. 6A and 7A) in which the control lines of the control valves 54 are operatively connected to the reservoir 58. The master control valve 52 thus places the slave control valves 54 in a first configuration in which fluid is allowed to flow between the first and second chamber portions 154 and 156.

With the master and slave valves 52 and 54 in the first configuration, a path is created that allows fluid to be forced out of the second chamber portion 156 by the upward movement of the piston head 142. The accumulator 56 is also operatively connected to the first chamber portion 154, so the fluid forced out of the second chamber portion 156 also flows into the accumulator 56. The check valve 60 is set to allow fluid to flow into the reservoir 58 when the accumulator 56 is filled to capacity.

Accordingly, when the master control valve 52 is placed in its first configuration, the piston assembly 132 is moved to its upper position and held there until the master control valve 52 changes it state. The ram member 120, which is connected to the piston rod 140, is thus held in its first, upper, position.

Figure 6B:
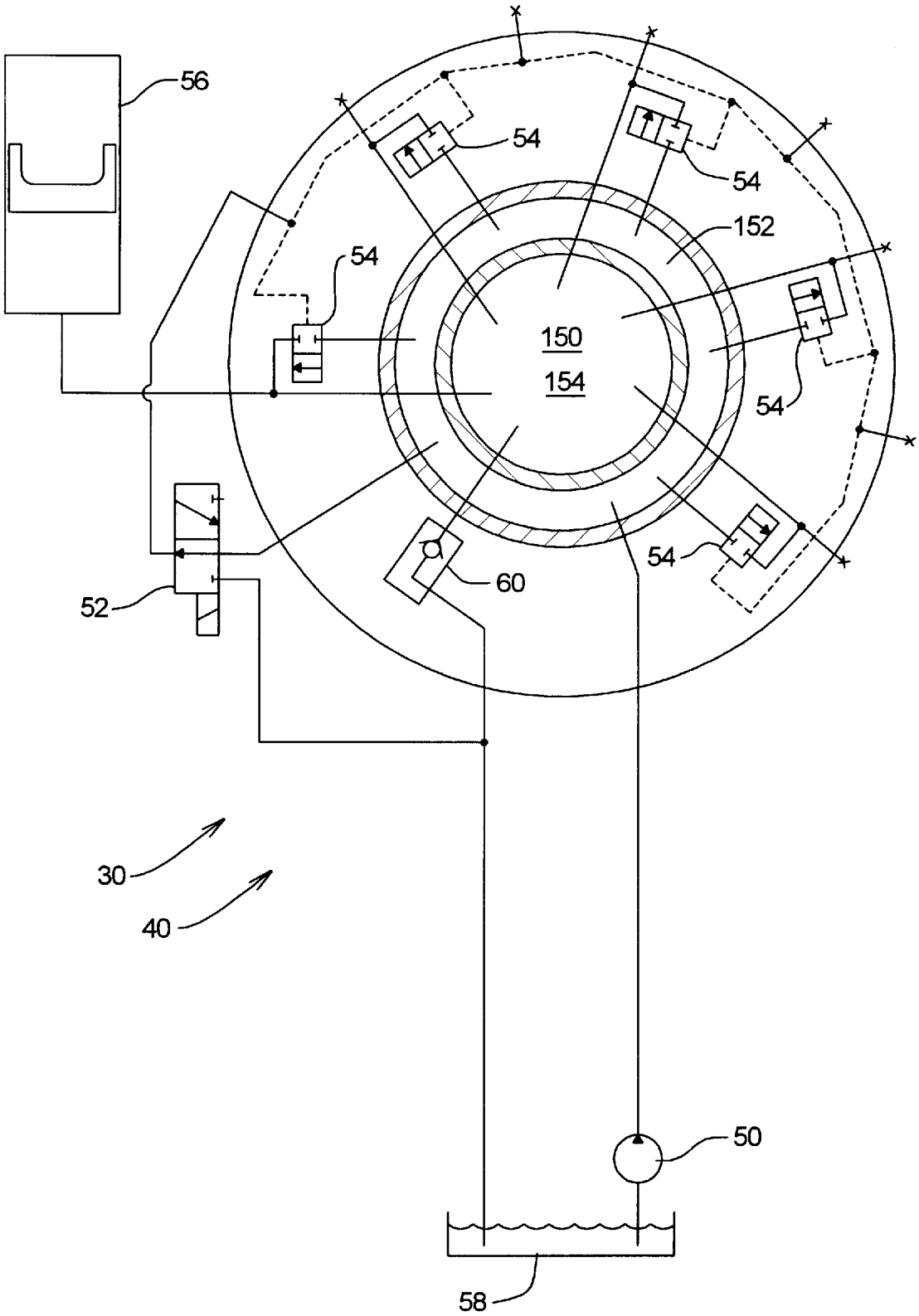
Figure 7A:
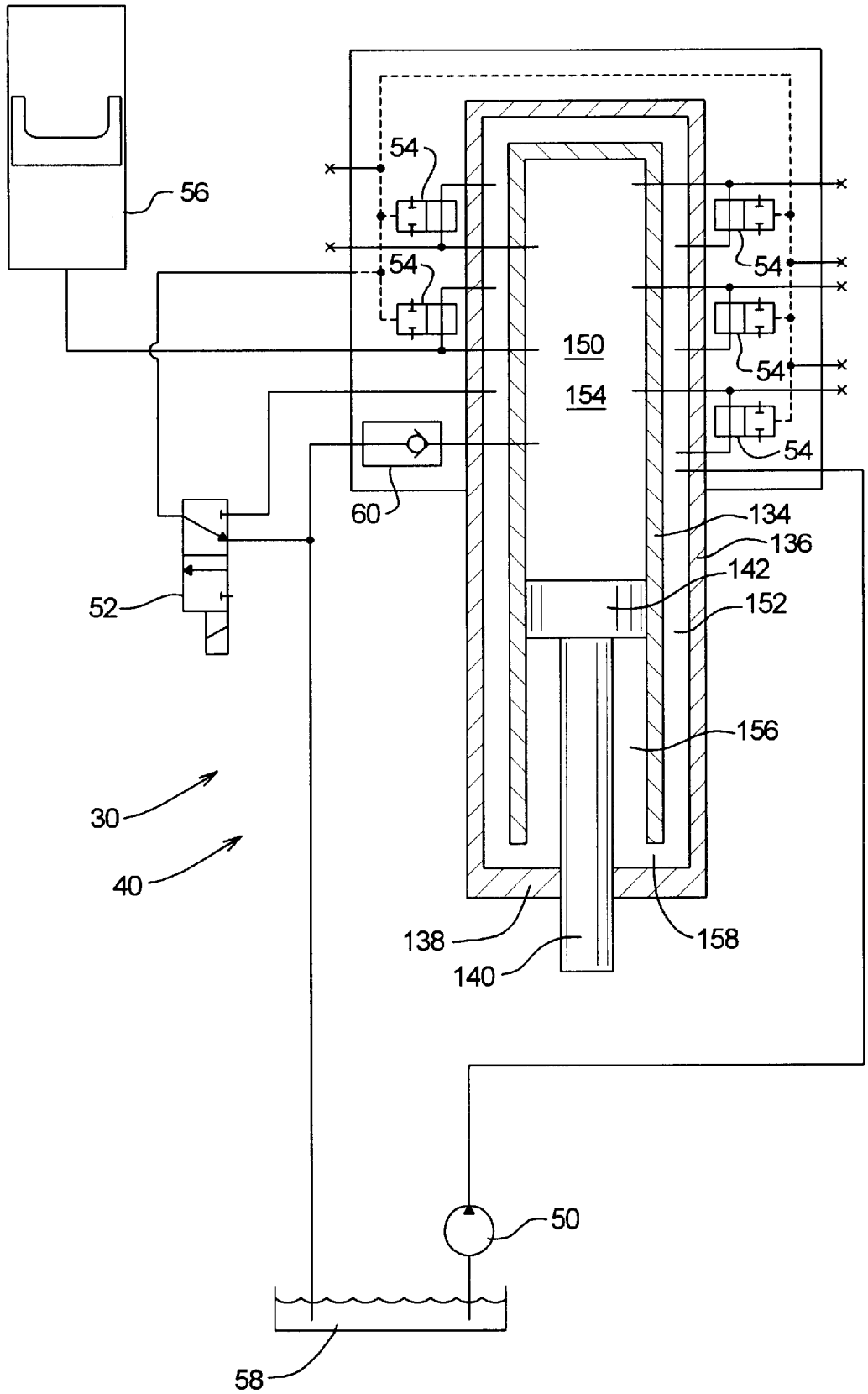
FIGS. 7A and 7B are somewhat schematic views depicting the hydraulic system of FIGS. 6A and 6B and an actuator assembly employed by the impact hammer system of FIG. 1 in the lifting and dropping states.
Figure 7B:
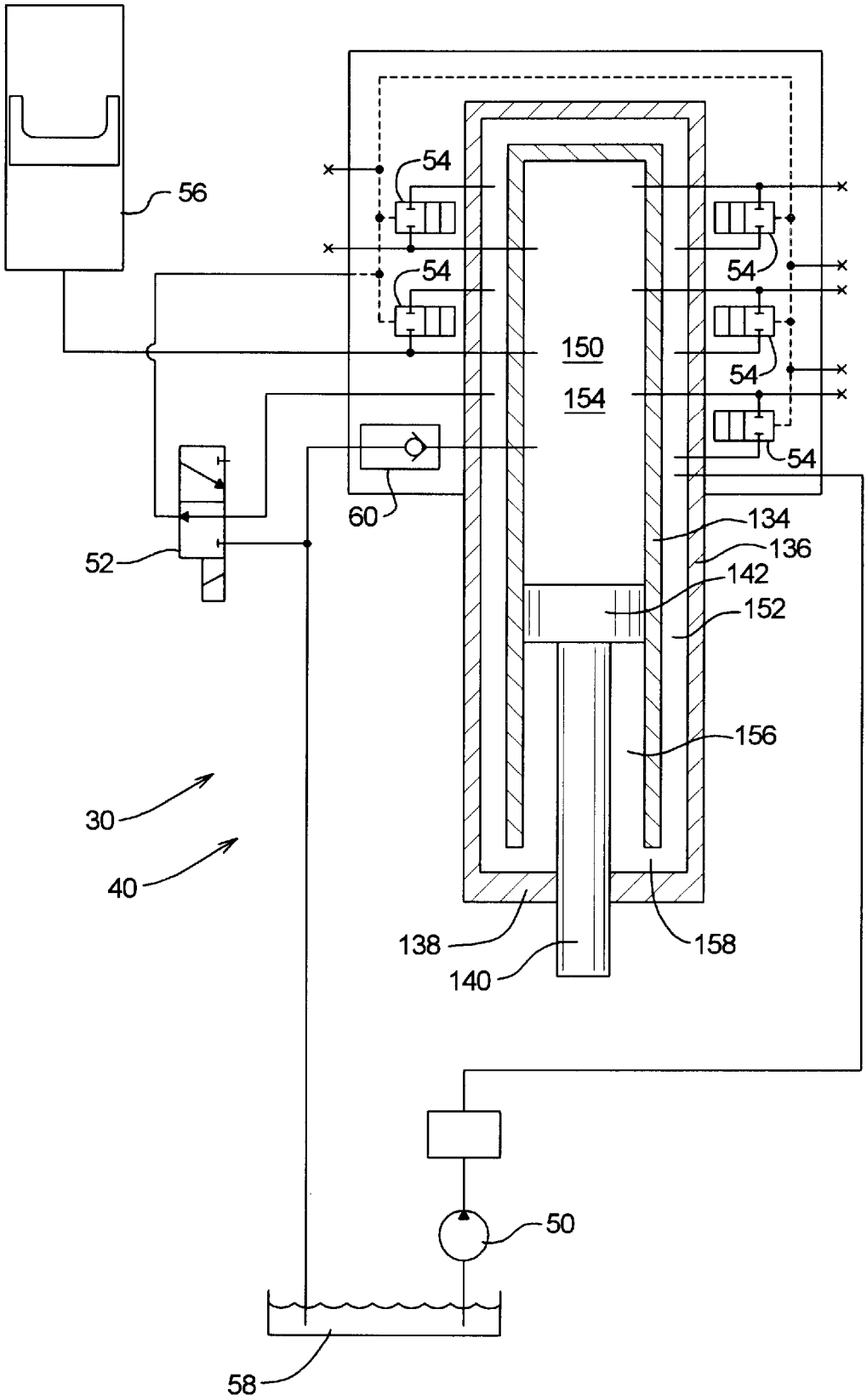

When the master control valve 52 changes to its second configuration, pressurized fluid within the outer housing chamber 152 is allowed to flow to the slave valves 54, thereby changing these valves 54 to their second configuration (FIGS. 6B and 7B). At the same time, the flow of pressurized fluid from the fluid source 50 is discontinued. At this point, the fluid in the second portion 156 of the inner housing chamber 150 and in the outer housing chamber 152 is no longer under pressure, and gravity causes the ram member 120 to move from the first, upper, position to the second, lower, position.

Although some resistance to fluid flow within the hydraulic system 40 will oppose downward movement of the ram member 120, the system 40 is designed to minimize such resistance, resulting in a near free fall of the ram member 120 from the upper to the lower position. In particular, the accumulator 56 stores under pressure sufficient hydraulic fluid to fill the first portion 154 of the inner housing chamber 150 as the ram member 120 moves from its upper position to its lower position.

If the fluid source 50 allows sufficient flow rates, the accumulator 56 may be omitted and the fluid source directly connected to the first chamber portion 154 through an appropriate control valve. However, conventional power packs on the market have limited flow rates, and the accumulator 56 allows the use of these conventional power packs without modification.

In use, the master control valve 52 will be returned to its first configuration and the fluid source 50 actuated to raise the ram member 120 to its first, upper, position and begin the process of repeating the cycle. This cycle will be repeated, raising and dropping the ram member 120 on the pile or elongate member 22, until the pile 22 is driven to a desired depth.

The hydraulic system 40 described herein is exemplary only, and other systems and methods of causing extension and retraction of the actuator assembly 124 may be employed while implementing the principles of the present invention.

In addition, while the cycle described herein can be implemented manually, this cycle can also be automated with appropriate control circuitry and/or sensors to repeat until the pile 22 reaches its desired depth. Such automation circuitry would be well within the capabilities of one ordinary skill in the art, is not per se part of the present invention, and thus will not be described herein in further detail.

Referring now to the details of the frame assembly 122, this assembly 122 is primarily designed to support the ram member 120 and actuator assembly 124 as the ram member 120 moves between the upper and lower positions as described above. The frame assembly 122 described herein represents the best mode for implementing the present invention, but other frame assemblies that support movement of the ram member 120 may be used in place of the exemplary frame assembly 122. However, a number of optional features of the frame assembly 122 optimize the results obtained by the present invention and will now be described in further detail, primarily with reference to FIG. 2.

The exemplary frame assembly 122 is provided with a housing assembly 170 and a striker member 172. The housing assembly 170 defines a ram area 174 and a striker area 176. The ram member 120 is supported by and moves relative the housing assembly 170 within the ram area 174. The striker member 172 is similarly supported by and moves relative to housing assembly 170 within the striker area 176. During normal use, housing assembly 170 will be oriented such that the striker area 176 is arranged below the ram area 174.

Figure 5:
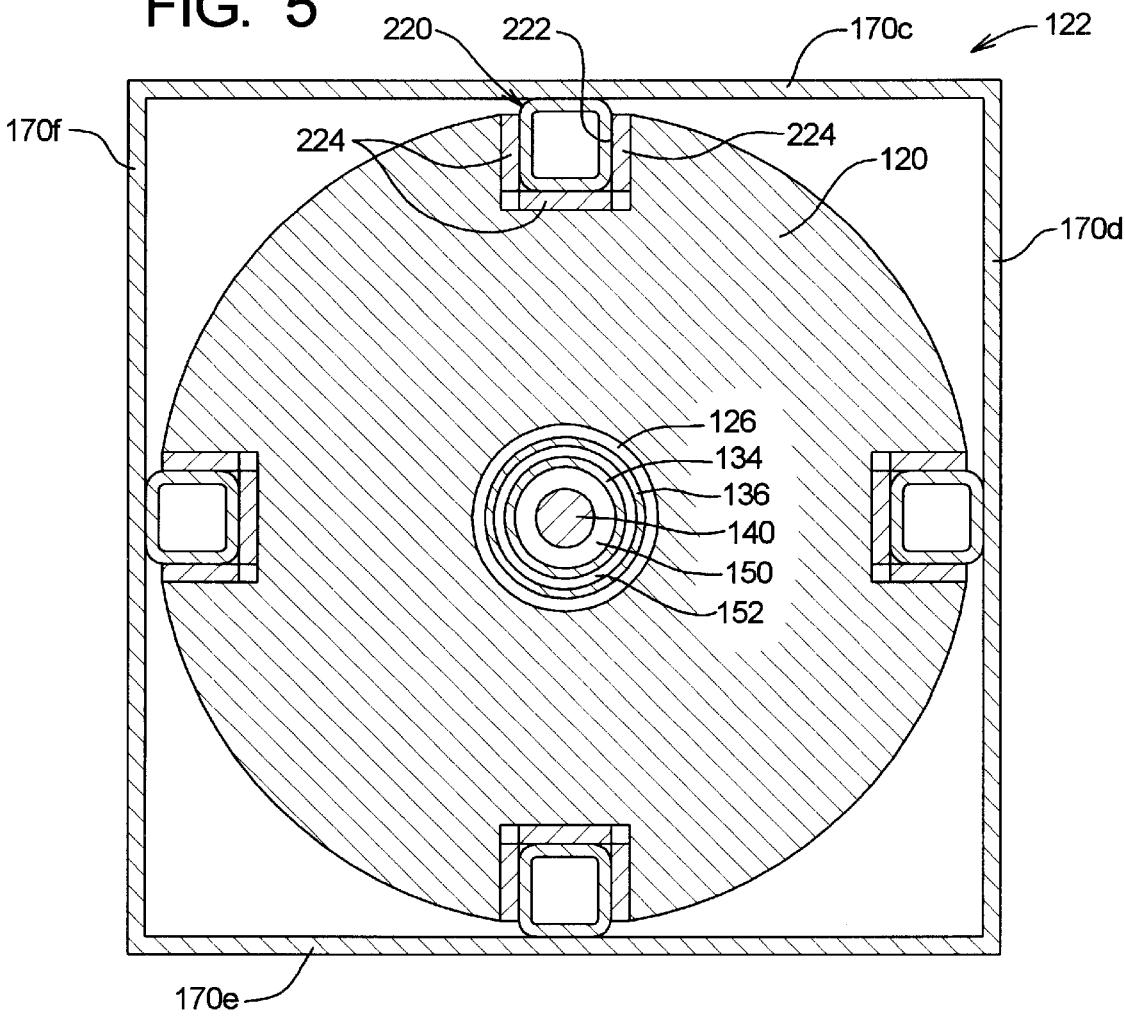
FIG. 5 is a horizontal section view of the impact hammer system of FIG. 1.

The housing assembly 170 comprises an upper wall 170*a*, a lower wall 170*b*, and first through fourth side walls 170*c–f* (FIG. 5). The exemplary housing assembly 170 is in the shape of a hollow rectangle, but other shapes are possible. A ram opening 171 is formed in the lower wall 170*b*, and the ram member 120 extends through this opening 171 to strike the striker member 172.

Figure 2:
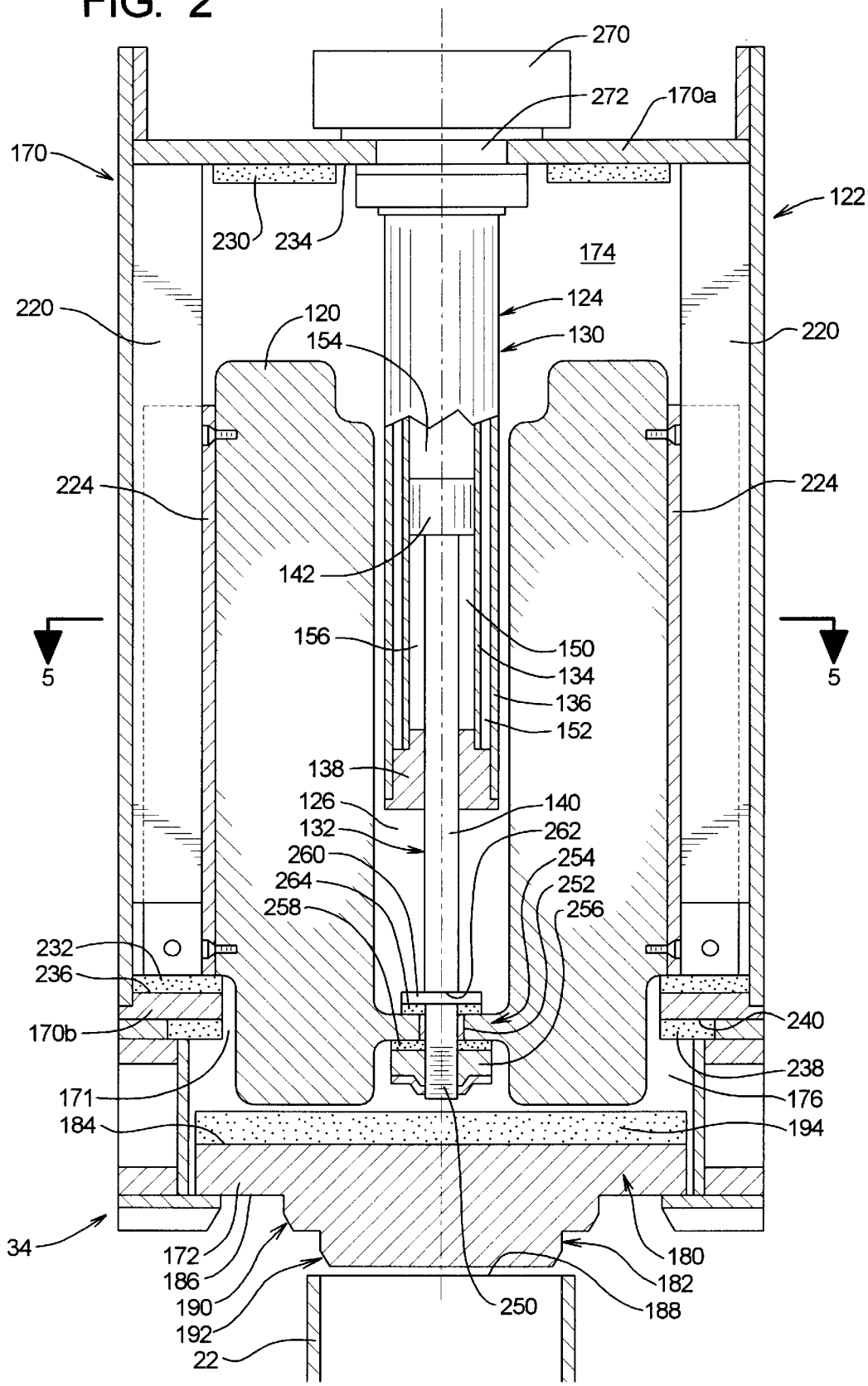
FIGS. 2–4 are a vertical section views of the impact hammer system of FIG. 1 in first, second, and third states, respectively.

The striker member 172 moves relative to the housing assembly 170 between a first, or upper, position (FIGS. 3 and 4) and a second, or lower, position (FIG. 2). The striker member 172 further comprises an upper striker plate portion 180 and a lower, pile engaging portion 182. The ram member 120 impacts an upper surface 184 of the striker 15 plate portion 180 when dropped from the upper position (FIG. 3) to the lower position (FIG. 4). A bottom surface 186 of the pile engaging portion 182 is adapted to securely engage an upper end 188 of the pile 22; the exemplary surface 186 has first and second cross-sectional area portions 190 and 192 to accommodate piles of two different diameters.

A striker plate cushion 194 is mounted on the upper surface 184 of the exemplary striker member 172 to reduce wear on the ram member 120 and the striker member 172. The striker plate cushion 194 is not designed to absorb shocks, but rather forms a wear surface that can be removed and replaced with relatively little expense and labor.

The striker member 172 may be embodied in forms and configurations other than described above. In any event the present invention may be embodied without the use of a separate striker member.

As perhaps best shown in FIG. 5, one or more guide members 220 may be rigidly mounted to the inside of the housing assembly 170 to guide the ram member 120 as it moves between its first and second positions. The exemplary guide members 220 are rectangular tubes welded at ninety degree intervals around the ram member 120. These tubes 220 extend into grooves 222 formed in the ram member 120. The grooves 222 are lined with replaceable wear strips 224 that reduce friction during movement of the ram member 120 and wear on the ram member 120 and guide members 220.

Fewer or more guide members may be employed and may be arranged at different locations around the ram member 120; in addition, the guide members may take the form of grooves that receive projections extending from the ram member 120. In any event, the use of guide members, while preferred, is not essential to implement the principles of the present invention.

Referring now to FIG. 2, upper and lower bumper members 230 and 232 are shown mounted to upper and lower inner surfaces 234 and 236 of the upper and lower housing assembly upper and lower walls 170*a* and 170*b*. In addition, a rebound ring member 238 is mounted to a lower outer surface 240 of the housing assembly lower wall 170*b* around the ram opening 171.

As shown in FIG. 2, before the impact hammer system 30 is mounted on the pile 22, the ram member 120 will be in its second position, resting on the lower bumper member 232. Gravity will cause the striker member 172 to stay in its second, lower position.

Figure 3:
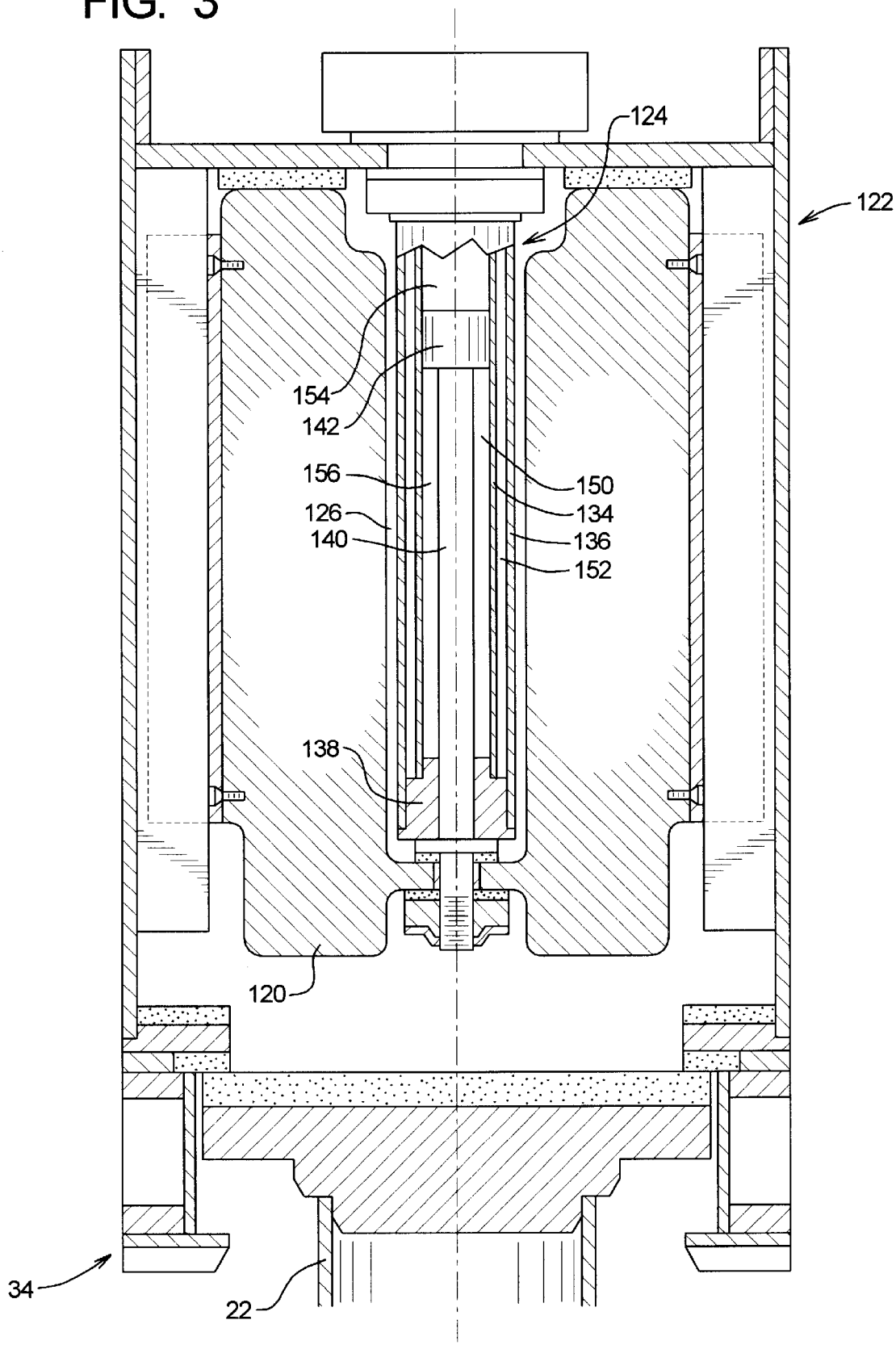
Figure 4:
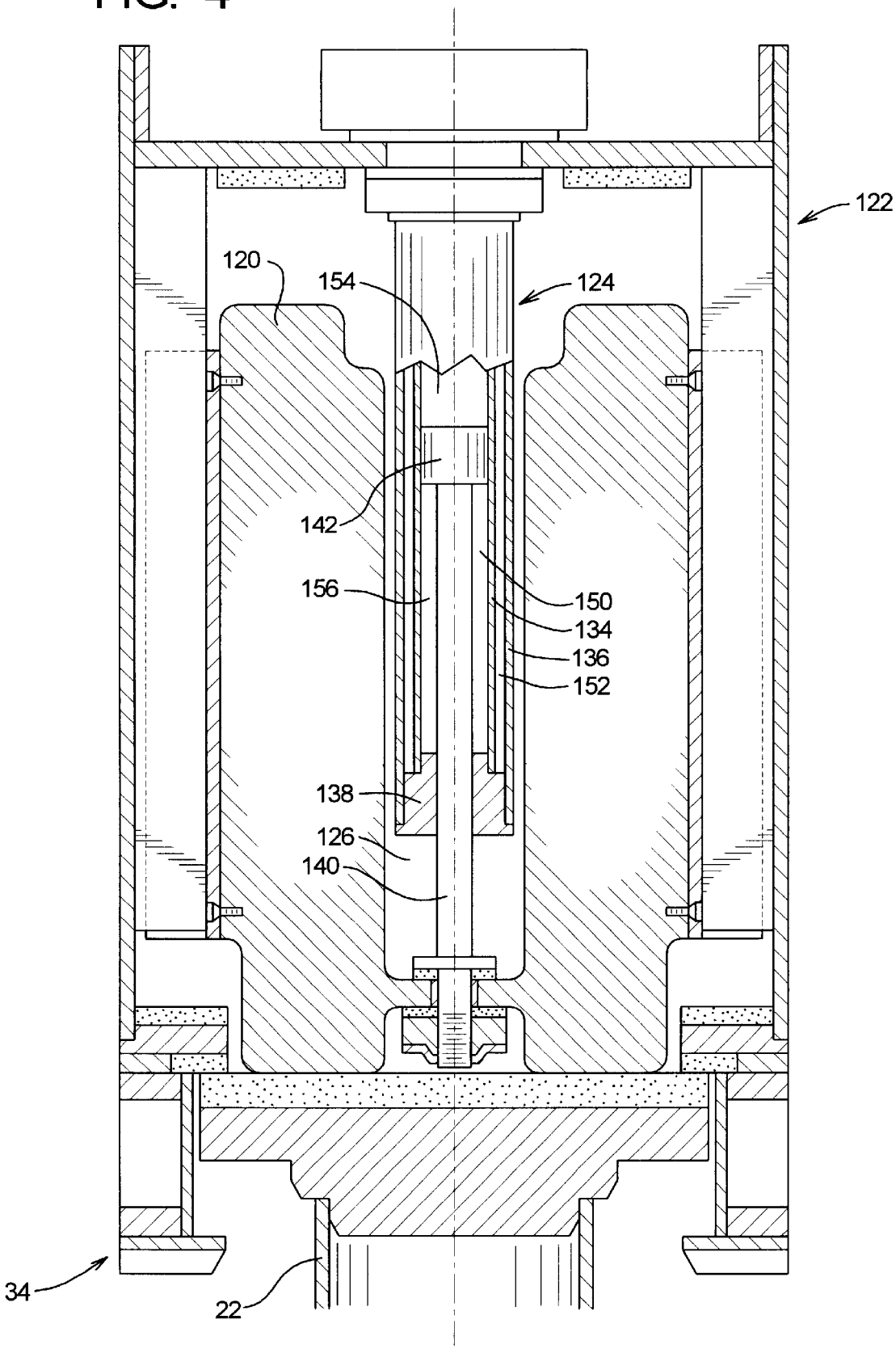

When the impact hammer system 30 is mounted on the pile 22, the striker member 172 will be supported by the pile 22, and the frame assembly 170 will drop such that the striker plate cushion 194 supports the frame assembly 170 through the rebound ring 238 (see, e.g., FIG. 3). The ram member 120 is then raised to its first, upper position as shown in FIG. 3, at which point the ram member 120 may engage the upper bumper member 230. The ram member 120 is then dropped to its second, lower position, at which point the ram member 120 strikes the striker plate cushion 194 as shown in FIG. 4.

Immediately after the situation depicted in FIG. 4, the ram member 120, striker member 172 and pile 22 move relative to the housing assembly 170 to drive the pile 22. At this point, the housing assembly 170 is no longer supported by the pile 22 through the striker member 172, so the housing assembly 170 will also fall and strike the pile 22 through the rebound ring 238, although with less force than the ram member 120.

Referring now again to FIG. 2, it can be seen that the piston rod 140 has a threaded, reduced diameter end 250 that extends through a through hole 252 formed in a lifting portion 254 of the ram member 120 at the bottom of the ram bore 126. A lifting nut 256 engages the threaded rod end 250 to cause the ram member 120 to move up as the piston rod 140 moves up. A lifting cushion 258 is arranged between the lifting nut 256 and the ram member 120. In addition, a stop ring 260 is arranged between a shoulder 262 formed by the reduced diameter end 250 of the piston rod 140 and the lifting portion 254 of the ram member 120. A backup cushion 264 is arranged between the stop ring 260 and the ram member lifting portion 254.

The lifting nut 256 and stop ring 260 ensure that the ram member 120 moves with the piston rod 140, while the lifting cushion 258 and backup cushion 264 reduce wear on the ram member 140 and piston rod 140 and are replaceable when worn.

The valves 154 are contained within a valve housing 270 mounted on the housing upper wall 170*a* above a cylinder opening 272. The wall assembly 130 of the actuator assembly 124 is rigidly connected to the housing upper wall 170*a* such that the first portion 154 of the inner housing chamber 150 and the outer housing chamber 152 are accessible through the cylinder opening 272. The use and location of the valve housing 270, while preferred, is not essential to implement the teachings of the present invention.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. An impact hammer system for driving an elongate member comprising:

a ram member defining a ram bore;

a frame assembly for supporting the ram member such that the ram member may move relative to the frame assembly between first and second positions;

an actuator assembly operatively connected between the frame assembly and the ram member, the actuator assembly being operable in extended and retracted configurations, where at least a portion of the actuator assembly is disposed within the ram bore and a substantial portion of the actuator assembly extends out of the ram bore when the cylinder is in the extended position; and a power source operatively connected to the actuator assembly to place the actuator assembly in the extended and retracted configurations; whereby extension and retraction of the actuator assembly moves the ram member between the first and second positions, respectively; and the ram member impacts the elongate member when the ram member moves into the second position.

2. An impact hammer system as recited in claim 1, in which the actuator assembly moves the ram member away from the elongate member when the actuator assembly changes from the extended configuration to the retracted configuration.

3. An impact hammer system as recited in claim 2, in which:

the housing assembly comprises an inner housing member defining an inner housing chamber and an outer housing member defining an outer housing chamber, where the inner housing member is disposed within the outer housing chamber; and the piston assembly comprises a piston head member operatively connected to a piston rod member, where the piston head member is disposed within the inner housing chamber and the piston rod member extends out of the inner and outer housing chambers.

4. An impact hammer system as recited in claim 3, in which the piston head member divides the inner housing chamber into first and second chamber portions, where the power source forces fluid into the first chamber portion through the outer housing chamber to place the actuator assembly into the retracted configuration.

5. An impact hammer system as recited in claim 4, in which the power source forces fluid into the first chamber portion to place the actuator assembly into the extended configuration.

6. An impact hammer system as recited in claim 5, further comprising a valve set arranged between the power source and the first and second chamber portions to control the flow of fluid between the power source and the first and second chamber portions.

7. An impact hammer system as recited in claim 1, in which an effective length of the actuator assembly is greater when the actuator assembly is in the extended configuration than when the actuator assembly is in the retracted configuration.

8. An impact hammer system as recited in claim 1, in which the actuator assembly comprises:

a housing assembly operatively connected to the frame assembly; and a piston assembly operatively connected to the ram member; whereby when the actuator assembly is in the retracted configuration, a substantial portion of the piston assembly is retracted within the housing assembly; and when the actuator assembly is in the extended configuration, a substantial portion of the piston assembly extends out of the housing assembly.

9. An impact hammer as recited in claim 1, in which the power source comprises a source of pressurized fluid and an accumulator for storing pressurized fluid.

10. An impact hammer system as recited in claim 1, further comprising a striker member, where the ram member impacts the elongate member through the striker member.

11. An impact hammer system as recited in claim 10, in which the frame assembly comprises a striker member housing assembly, where the striker member housing assembly limits movement of the striker member relative to the frame assembly.

12. An impact hammer system as recited in claim 1, further comprising guide channels formed on one of the ram member and the frame assembly and guide rails formed on the other of the ram member and the frame assembly, where the guide rails engage the guide channels to direct movement of the ram member along a ram axis.

* * * * *